US006779280B2

(12) United States Patent
Wright et al.

(10) Patent No.: US 6,779,280 B2
(45) Date of Patent: Aug. 24, 2004

(54) ANKLE STRENGTHENING THERAPEUTIC DEVICE AND METHOD

(76) Inventors: Sherry L. Wright, 1630 Sophia Dr., Oxnard, CA (US) 93030; Elizabeth M. Pretorius, 1630 Sophia Dr., Oxnard, CA (US) 93030

( * ) Notice: Subject to any disclaimer, the term of this patent is extended or adjusted under 35 U.S.C. 154(b) by 82 days.

(21) Appl. No.: 10/123,443

(22) Filed: Apr. 15, 2002

(65) Prior Publication Data

US 2003/0192198 A1 Oct. 16, 2003

(51) Int. Cl.[7] ..... A43B 3/18; A43C 15/02; A43C 15/12

(52) U.S. Cl. ..... 36/7.7; 36/59 R; 36/114; 36/62; 36/59 C; 482/114

(58) Field of Search ..... 36/7.7, 136, 59 R, 36/114, 132, 7.1 R, 7.2, 7.6, 71, 61, 62, 66, 59 C, 59 D; 482/74, 51, 79, 125, 105, 114

(56) References Cited

U.S. PATENT DOCUMENTS

| | | | | | |
|---|---|---|---|---|---|
| 1,018,708 | A | * | 2/1912 | Hetrick | 36/132 |
| 1,319,021 | A | * | 10/1919 | Thompson | 36/7.7 |
| 1,615,498 | A | * | 1/1927 | Anderson | 36/7.1 R |
| 1,978,711 | A | | 10/1934 | Keely | |
| 2,216,947 | A | * | 10/1940 | Jones | 36/7.7 |
| 2,450,768 | A | | 10/1948 | Pulver | |
| 2,532,485 | A | | 12/1950 | Dowling | |
| 2,547,812 | A | * | 4/1951 | Carabatsos | 36/7.1 R |
| 2,628,437 | A | * | 2/1953 | Forsythe | 36/7.2 |
| 2,714,768 | A | | 8/1955 | Badler | |
| 2,745,041 | A | * | 5/1956 | Price | 36/7.2 |
| 4,108,452 | A | * | 8/1978 | Baron | 36/136 |
| 4,249,226 | A | | 2/1981 | Westberg et al. | |
| 4,271,605 | A | * | 6/1981 | Raczka | 36/7.2 |
| 4,645,466 | A | * | 2/1987 | Ellis | 36/132 |
| 4,702,021 | A | | 10/1987 | Cameron | |
| D336,559 | S | | 6/1993 | Carmichael | |
| 5,259,125 | A | * | 11/1993 | Gromes | 36/59 R |
| D362,109 | S | | 9/1995 | Jones | |
| 5,485,687 | A | | 1/1996 | Rohde | |
| 5,737,856 | A | | 4/1998 | Brockman | |
| 5,893,223 | A | | 4/1999 | Glass | |
| 5,943,792 | A | | 8/1999 | Powell | |

* cited by examiner

*Primary Examiner*—Anthony Stashick
(74) *Attorney, Agent, or Firm*—Gordon & Rees LLP

(57) ABSTRACT

A gait adjusting device or harness is designed for attachment to an item of footwear, such as an athletic shoe. The harness has a panel with a lower face of predetermined adhering material designed to releasable attach or stick to a carpeted surface. A first set of straps extends from the panel for securing around the top of a shoe with the panel extending transversely across the sole of the shoe with the carpet adhering face facing downwardly, and a second set of straps extends from the panel in a direction transverse to the first set of straps for securing around the heel end of the shoe, securely holding the panel in the desired position.

11 Claims, 2 Drawing Sheets

ANKLE STRENGTHENING THERAPEUTIC DEVICE AND METHOD

BACKGROUND OF THE INVENTION

The present invention relates to therapeutic or training devices for attachment to footwear in order to adjust an individual's gait for training, strengthening, and/or therapeutic purposes.

Removable devices for attachment to a person's footwear have been used in the past for various purposes. Some such devices involve belts or straps which are secured around a wearer's shoes and have frictional components attached for providing enhanced traction. These may be used, for example, when the wearer is walking on slippery surfaces such as ice or snow. Improved traction devices are described in U.S. Pat. Nos. 5,943,792 of Powell, 4,702,021 of Cameron, and 5,485,687 of Rohde, for example.

U.S. Pat. No. 5,893,223 of Glass describes a stretch fabric garment designed to be attached to a shoe and having pockets for receiving weights. The garment has a pocket which engages over the toe portion of the shoe, and a strap which extends from the pocket around the rear of the shoe. Pockets are provided in the toe and around the strap. The weighted footwear garment serves as a training or therapeutic device.

SUMMARY OF THE INVENTION

It is an object of the present invention to provide a new and improved gait adjusting device designed for attachment to footwear for use in exercise, training, and/or therapy.

According to one aspect of the present invention, a gait adjusting device is provided, which comprises a panel having opposite first and second faces, the second face being of a material which will adhere to the fibers of a carpet, such as hook-type Velcro®, a first set of straps extending from the panel for securing around the top of the shoe with the panel extending transversely across the sole of a wearer's shoe in the area of the ball of the foot, with the second face facing downwardly, and a second set of straps extending from the panel in a direction transverse to the first set of straps for extending from the toe portion along opposite sides of a wearer's shoe and around the heel end of the shoe to secure the panel at a predetermined axial position on the sole of the shoe.

In an exemplary embodiment of the invention, the panel is rectangular, with opposite longitudinal sides and opposite ends. The first set of straps extend from the opposite ends of the panel, and the second set extend from one side. The first set of straps may comprise two spaced, parallel pairs of straps, each pair comprising a first strap secured to one end of the panel and having a first fastener at its end, and a second strap secured to the other end of the panel in alignment with the first strap and having a second fastener at its end for releasable mating engagement with the first fastener. The second set of straps may comprise a first strap secured to one side edge of the panel adjacent a first end, and a second strap secured to the same side edge adjacent the second end of the panel. When the panel is secured across the sole of the shoe or other footwear, its ends will extend up over opposite sides of the shoe, such that each second strap faces rearwardly along the respective side towards the heel of the shoe, and the longer of the two straps can be extended around the heel and secured to the other strap, securely positioning the panel.

In use, a gait adjusting device is secured to each of the wearer's shoes or other footwear. The wearer then walks on a carpeted surface. The hook fastener material will tend to attach or stick to the carpet, making it harder for the wearer to pick up his or her foot. This device provides proprioceptive and sensory input through vision, sound and feel, with instant feedback as the user moves their feet. This will deter bad gait habits such as scuffing and will encourage good habits such as hip and knee flexion and dorsiflexion in the swing phase of gait. The device will assist in normalizing the gait pattern, and will also tend to strengthen the ankle musculature, particularly the anterior tibialis, as a result of the extra force needed to pull the foot from the carpet.

According to another aspect of the present invention, a method of adjusting a person's gait is provided, which comprises the steps of:

extending a panel across the sole of a wearer's footwear with a carpet adhering material extending over one face of the panel facing downwardly and opposite ends of the panel extending up along the sides of the shoe towards the top of the toe portion of the shoe;

extending at least one pair of fastener straps from opposite ends of the panel up over the toe portion of the footwear and securing the straps together to secure the panel to the sole of the footwear;

extending a second pair of fastener straps from locations on one side edge of the panel positioned on opposite sides of the footwear towards the heel end of the footwear, at least one of the second pair of straps extending around the heel end of the footwear to meet the other strap; and securing the second pair of straps together to hold the panel in a selected axial position on the sole of the footwear;

whereby, when the wearer of the footwear walks on a carpeted surface, the carpet adhering material will be releasably attached to the carpet and provide resistance to the pulling up of the footwear from the carpet, thereby adjusting the wearer's gait.

The device and method of this invention can be used to assist patients with a wide variety of neurological and orthopaedic diagnoses, as well as in treatment of various bad gait habits. When two devices are used, one on each foot, the patient is provided with an immediate auditory and proprioceptive feedback to improve symmetry in stride length and normalize the gait pattern. The auditory feed back results from the sound of the carpet adhering material, which may be Velcro® hook type material, pulling away from the carpet, while the resistance to the material pulling off the carpet provdies proprioceptive feedback, causing the wearer to use more force in lifting their foot. The device is inexpensive, and is easy and fun to use.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
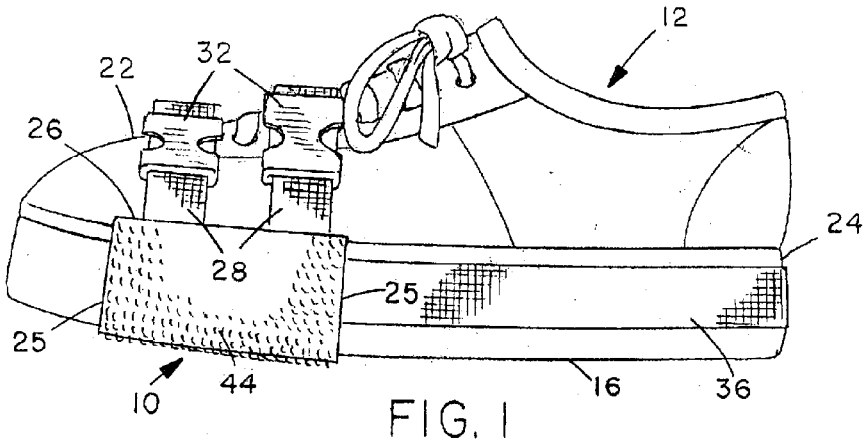
FIG. 1 is a left side view of a typical shoe with a gait adjusting device according to an exemplary embodiment of the invention attached.
Figure 2:
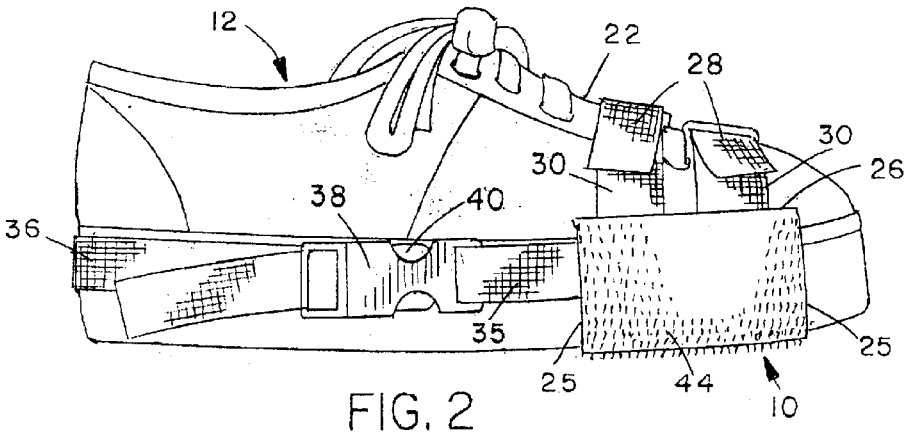
FIG. 2 is a right side view of the shoe and harness.

The drawings illustrate a gait adjusting device or harness 10 according to an exemplary embodiment of the invention, with FIGS. 1 and 2 illustrating the device attached to a wearer's athletic shoe 12. It will be understood that the device may be attached to any type of footwear in a similar manner, and that two such devices may be used if desired, one attached to each of the wearer's shoes or footwear.

The harness 10 basically comprises a rectangular panel 14 designed to extend transversely across the sole 16 of a shoe 12 in the toe and ball of the foot region, and two sets of straps 18,20 for securing around the top 22 and heel end 24 of the shoe, respectively, in order to hold the panel 14 in position. The panel 14 is of rectangular shape and has opposite side edges 25 and ends 26.

The first set of straps 18 comprises two pairs of straps extending from the opposite ends 26 of the panel for securing over the top of the shoe in the toe region. A first strap 28 of each pair extends from one end of the panel, and a second strap 30 extends from the opposite end in alignment with the first strap. A first fastener or clasp member 32 is secured to the end of each first strap 28, while a second fastener or clasp member 34 is secured to the end of each second strap 30. Any suitable fastener devices may be used, such as the mateable side release snap fasteners or buckles 32, 34 as illustrated, other types of buckles, or mating matches of hook and loop type fastener material, such as Velcro®. The second straps 30 are adjustable in length by looping different lengths of strap 30 through the strap attachment portion of buckle 34, in a conventional manner. One of the straps 30 will be longer than the other second strap 30, as best illustrated in FIG. 3, since one pair of straps has to extend a farther distance to reach over the top of the shoe closer to the ankle opening of the shoe.

Figure 3:
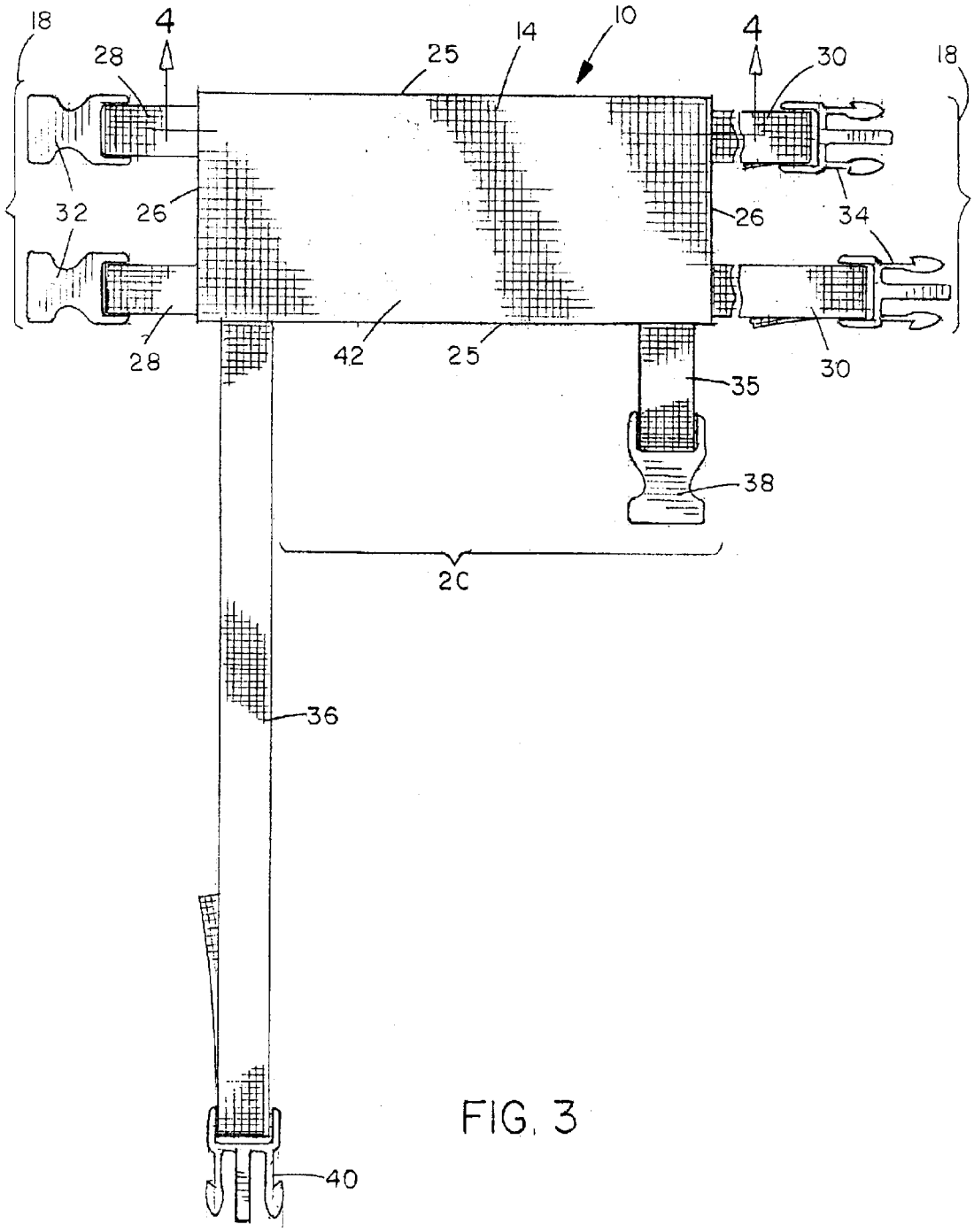
FIG. 3 is a top plan view of the harness in flattened position.

The other set of straps comprises a first, short strap 35 extending from one side edge of the panel adjacent one end of the panel, and a second, longer strap 36 extending from the same side edge of the panel adjacent the opposite end of the panel, as illustrated in FIG. 3. A first fastener or buckle 38 is secured to strap 35, while a second fastener or buckle 40 for mating, snap engagement with buckle 38 is secured to strap 36. As in the first set of straps, the length of strap 36 may be adjusted by extending different amounts of the strap through the strap attachment portion of buckle 40.

Figure 4:
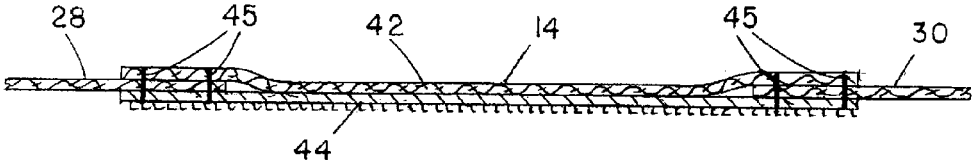
FIG. 4 is an enlarged sectional view taken on line 4—4 of FIG. 3.

The panel comprises a first layer 42 of backing material such as elasticated fabric or the like, and a second layer 44 of hook-type Velcro® material, secured to the first layer with the hook side facing outwards, as indicated in FIG. 4. The second layer may be secured to the first layer in any suitable manner, for example by stitching 45 as indicated in FIG. 4. In an alternative embodiment, the panel may comprise a single layer of hook-type fastener material. Other materials may be used in place of the hook-type fastener material, with the requirement being that the material has a surface texture which will tend to stick or adhere to a carpeted surface. For example, a material with a sticky or adhesive outer surface may be used. The straps may be of any suitable material, such as webbing, and may be secured at their inner ends to the panel 14 by the same stitching 45 which secures the two layers of the panel together, as indicated in FIG. 4.

In order to attach the harness 10 to a shoe, the harness is first placed flat on the ground with the hook side of layer 44 facing downwards, exactly as illustrated in FIG. 3. The shoe is then placed over the panel 14 so that the ball portion of the sole is resting on the panel and the panel extends transversely across the sole of the shoe with the straps 35 and 36 extending towards the heel end of the shoe. The first set of straps is then pulled up and over the top of the shoe, snapping the two pairs of buckles 32,34 together and adjusting the strap lengths as needed to ensure a snug fit (see FIGS. 1 and 2). At this point, the straps 35 and 36 will be located adjacent the opposite sides of the shoe, facing towards the heel. The longer strap 36 is then extended around the heel end 24 of the shoe and the buckle 40 is snapped into buckle 38, adjusting the length of the strap to fit the length of the shoe. The two sets of straps will therefore secure the panel 14 in the desired position extending across the sole of the shoe, as indicated in FIGS. 1 and 2. The same process is repeated to secure a second gait adjusting harness to the other shoe.

The gait adjusting device is intended to be used with appropriate safety devices, such as a hand bar or a safety belt, since it will challenge a user's balance. It should also be used only over appropriate footwear, such as athletic shoes or other closed toe shoes providing adequate support. Once a harness has been attached to one or both shoes in the manner indicated in FIGS. 1 and 2, the wearer walks on a carpeted surface. The downwardly facing hook surface will tend to adhere or attach to the carpet fibers, "sticking" to the carpet and making it more difficult for the user to lift their foot.

As the user lifts their foot away from the carpet, they have to use more force than usual, and will also hear the sound of the hook material ripping away from the carpet. This provides them with instant feedback in sound and feel. The device will deter bad gait habits such as scuffing and will encourage good habits such as hip and knee flexion and dorsiflexion in the swing phase of gait. It will also assist in normalizing the gait pattern. The extra force needed to raise each foot will exercise and tend to strengthen the ankle musculature, especially the anterior tibialis. The device provides proprioceptive and sensory input through vision, sound and feel. The gait harness of the invention is easy to use, and can be used for a wide variety of purposes, such as treatment of neurological or orthopaedic conditions, physical therapy, exercise, and training. Use of the device on both feet will tend to improve symmetry in stride length. The device is inexpensive, and is easy to use, store, and clean.

Although the carpet adhering panel in the illustrated embodiment is rectangular in shape, it may be of other shapes such as square, oval, round, or the like. Any suitable fasteners may be used for securing it around the front portion and heel of the shoe. One pair of fastener straps, instead of two, may be provided for extending over the top of the shoe, and other releasable fastener devices may be used in place of the snap fasteners 32,34 and 38,40, such as mating patches of hook and loop fastener material, hook and eye fasteners, or the like. Laces or strings which are tied together at their ends, like shoe laces, may also be used in place of the fastener straps with buckles. As has been noted above, any suitable material which tends to adhere to carpet fibers may be used in place of the hook type fastener material, such as any material with adhesive properties.

The harness will be made in at least three different sizes to fit different widths and lengths of feet and footwear. In an exemplary embodiment, panel 14 was provided in 3 inch widths and lengths of around 9 inches, 7 inches, and 5–5½ inches. The associated straps may also be provided in a range of different lengths.

Although an exemplary embodiment of the invention has been described above by way of example only, it will be understood by those skilled in the field that modifications may be made to the disclosed embodiment without departing from the scope of the invention, which is defined by the appended claims.

We claim:

1. A gait adjusting apparatus, comprising:

a panel having opposite first and second faces, the second face being of a predetermined material for releasably adhering to carpet;

a first set of straps extending from said panel for securing around the top of a shoe with the panel extending transversely across the sole of the shoe with the second face facing downwardly;

a second set of straps extending from the panel in a direction transverse to the first set of straps for securing around the heel end of the shoe to secure the panel at a predetermined axial position on the sole of the shoe;

the panel being of rectangular shape and having opposite longitudinal sides and opposite ends, the sides having a length greater than that of the ends, the first set of straps extending from the opposite ends of the panel, and the second set of straps extending from one side of the panel in a direction perpendicular to the first set of straps.

2. The apparatus as claimed in claim 1, wherein the carpet adhering material comprises hook type fastener material.

3. The apparatus as claimed in claim 1, wherein the first set of straps comprises at least one first strap extending from one end of the panel, and at least one second strap extending from the opposite end of the panel in alignment with the first strap, a first fastener secured to the first strap, and a second fastener secured to the second strap for releasable mating engagement with the first fastener.

4. The apparatus as claimed in claim 3, wherein at least one of the straps is adjustable in length.

5. The apparatus as claimed in claim 3, including two first straps extending from one end of the panel and two second straps extending from the other end of the panel.

6. The apparatus as claimed in claim 5, wherein the second straps are of different lengths.

7. The apparatus a claimed in claim 1, wherein the second set of straps comprises a first strap secure to a first side edge of the panel adjacent a first end, and a second strap secured to the first side edge adjacent the second end of the panel, each strap of the second set having fastener for releasable engagement with the fastener of the other strap.

8. The apparatus as claimed in claim 7, wherein the second strap of the second set of straps is of predetermined length for extending from the panel around the heel end of a shoe for attachment to the first strap of the second set of straps.

9. The apparatus as claimed in claim 8, wherein the second strap of the second set is of adjustable length.

10. The apparatus as claimed in claim 1, wherein the panel is of predetermined length fore ending across the sole of a shoe and up over at least part of each side of the shoe.

11. The apparatus as claimed in claim 1, wherein first and second set of straps are coplanar with the panel when not attached to a user's shoe.

* * * * *

UNITED STATES PATENT AND TRADEMARK OFFICE

CERTIFICATE OF CORRECTION

PATENT NO. : 6,779,280 B2
DATED : August 24, 2004
INVENTOR(S) : Sherry L. Wright and Elizabeth M. Pretorius It is certified that error appears in the above-identified patent and that said Letters Patent is hereby corrected as shown below:

Column 6,
Line 2, change “secure” to -- secured --.
Line 2, change “fore” to -- for --.

Signed and Sealed this

Fifth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,779,280 B2
DATED : August 24, 2004
INVENTOR(S) : Sherry L. Wright and Elizabeth M. Pretorius It is certified that error appears in the above-identified patent and that said Letters Patent is hereby corrected as shown below:

Column 6,
Line 11, change “secure” to -- secured --.
Line 24, change “fore” to -- for --.

This certificate supersedes Certificate of Correction issued April 5, 2005.

Signed and Sealed this

Twenty-eighth Day of June, 2005

JON W. DUDAS
*Director of the United States Patent and Trademark Office*